United States Patent [19]

Bell, III et al.

[11] Patent Number: 4,747,249

[45] **Date of Patent: * May 31, 1988**

[54] SUBPURLIN AND ATTACHMENT ASSEMBLY

[75] Inventors: John R. Bell, III, Germantown; Robert E. Hodges, Jr., Memphis, both of Tenn.; Harold E. Martin, LaGrange, Ga.

[73] Assignee: AMCA International Corporation, Hanover, N.H.

[ * ] Notice: The portion of the term of this patent subsequent to Jun. 30, 2004 has been disclaimed.

[21] Appl. No.: 931,401

[22] Filed: Jan. 14, 1987

Related U.S. Application Data

[63] Continuation-in-part of Ser. No. 794,076, Nov. 1, 1985, Pat. No. 4,676,042.

[51] Int. Cl.[4] ..... E04D 1/34

[52] U.S. Cl. ..... 52/543; 52/748; 52/404; 52/534

[58] Field of Search ..... 52/543, 478, 508, 573, 52/698, 741, 480, 404

[56] References Cited

U.S. PATENT DOCUMENTS

| | | | |
|---|---|---|---|
| 3,031,044 | 4/1962 | Stitt et al. | 189/34 |
| 3,332,186 | 7/1967 | Cammaert | 52/534 X |
| 3,394,516 | 7/1968 | Taylor et al. | 52/410 |
| 3,975,880 | 8/1976 | Fischer, Jr. | 52/464 |
| 3,998,019 | 12/1976 | Reinwall, Jr. | 52/407 |
| 4,081,938 | 4/1978 | Bertacchi et al. | 52/410 |
| 4,114,338 | 9/1978 | Beck | 52/478 |
| 4,329,823 | 5/1982 | Simpson | 52/478 X |
| 4,361,993 | 12/1982 | Simpson | 52/404 X |
| 4,406,106 | 9/1983 | Dinges | 52/478 |
| 4,466,224 | 8/1984 | Hague | 52/478 |
| 4,486,998 | 12/1984 | Hague | 52/478 |
| 4,651,489 | 3/1987 | Hodges et al. | 52/748 X |

*Primary Examiner*—Henry E. Raduazo
*Assistant Examiner*—Creighton Smith
*Attorney, Agent, or Firm*—Richards, Harris, Medlock & Andrews

[57] ABSTRACT

A subpurlin (10) is provided for a building assembly having a plurality of overhead structural members (50), an insulating layer (62) and a plurality of overlapping roof panels (56). The subpurlins (10) support and space the roof panels (56) without compressing the insulating layer (62). Connector assemblies (30) secure the subpurlins (10) on the structural members (50) while permitting differential thermal movements between the roof panels (56) and the structural members (50). The connector assemblies (30) have ferrules (32) which slidingly engage slots (16) in the subpurlins (10). Washers (34) are fastened to the structural members (50) through the ferrules (32) during subpurlin (10) installation.

5 Claims, 3 Drawing Sheets

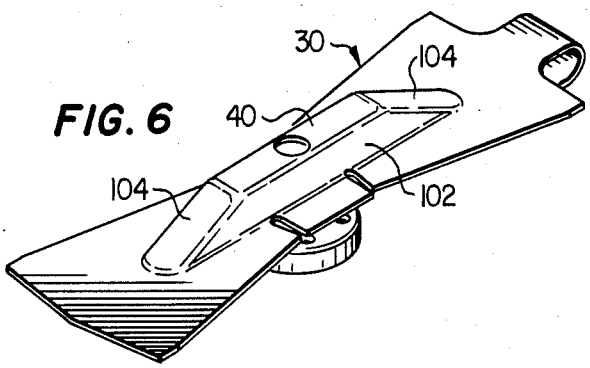
FIG. 6
FIG. 7
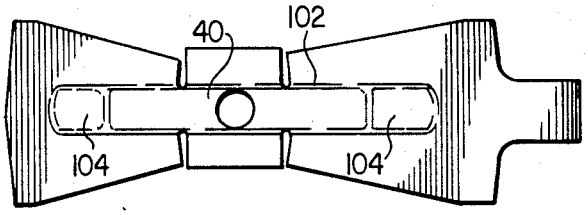
FIG. 8
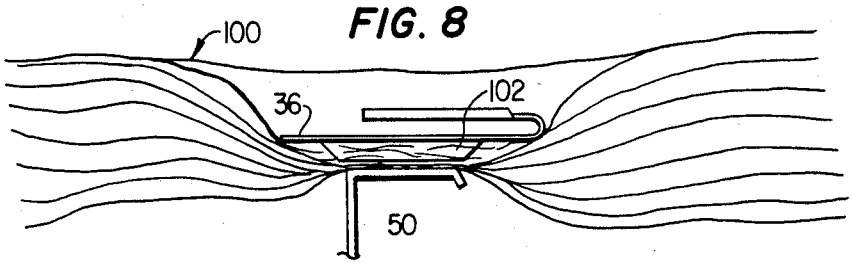
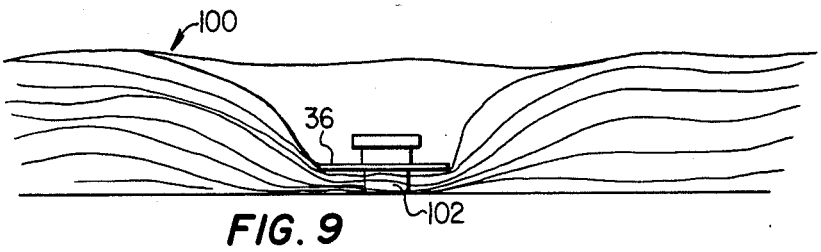
FIG. 9

SUBPURLIN AND ATTACHMENT ASSEMBLY

CROSS REFERENCE TO RELATED APPLICATIONS

This application is a continuation-in-part of U.S. patent application Ser. No. 794,076, filed Nov. 1, 1985 now U.S. Pat. No. 4,676,042.

FIELD OF INVENTION

This invention relates to metal building systems and, more particularly, to an intermediate subpurlin for spacing roof panels above an underlying support structure

BACKGROUND OF INVENTION

A typical roof structure for metal buildings includes a structural support system covered by a plurality of overlapping roof panels. Roof panels are generally formed from sheet materials to define ribs and other contours which provide rigidity and strength to the panels. Mating ribs may be provided where panels overlap for improved interlocking and weather integrity.

As a building heats and cools, the structural support system and the roof panels may experience dimensional changes from thermal expansion and contraction. There is frequently differential movement between the roof panels and underlying structure. Where the roof panels are rigidly fixed to the underlying structure, stresses and physical deformation can be produced in the roof panels, particularly along panel widths perpendicular to the panel ribs.

In a conventional building system, the roof panels are fastened to the underlying structure at low points or valleys in the panel contour. Water run-off and collection also occur along the panel valleys. Thus, the valley locations where fasteners penetrate the roof panels are often the source of water leakage and of roof panel degradation.

A building roof structure may also include an insulating layer between the structural support system and the overlying roof panels. The thickness of the insulating layer may be considerably reduced where the roof panels are fixed to the structure. Compressing the insulating layer thickness greatly decreases the insulating effectiveness of the layer.

U.S. Pat. No. 4,114,338 to Beck teaches a reinforcing plate for use beneath end lapped thin gauge sheets to provide structural support adjacent the joints for improved sealing. The reinforcing plate is elevated above the underlying insulation and is fastened to an underlying purlin through downwardly depending flanges having mounting slots therein. However, there is no provision to assure that the reinforcing plate is not rigidly fixed to the underlying structure. Further, the roofing sheets are fixed to the reinforcing plates along valleys where water run-off and collection can occur.

U.S. Pat. Nos. 4,361,993 and 4,329,823 to Simpson teach a support spacer apparatus for engaging an overlying ribbed panel in a manner to support the panel above the building support structure without compressing the underlying insulation. However, Simpson rigidly fastens the component parts together to provide for structural strength increases.

U.S. Pat. No. 3,332,186 to Cammaert does teach structure for enabling relative movements between corrugated sheet roofing and underlying rafters. Sliding members are fixed to raised corrugations and engage intermittent slideways which are fixed to the rafters to enable relative movements parallel to the corrugations. There is no suggestion about adapting the slider and slideway system to an insulated assembly.

These and other disadvantages in the prior art are overcome by the present invention wherein a subpurlin is provided in a contour effective to support roof panels without compressing underlying insulation while providing elevated fastening support areas and having a clip for slidably fastening the subpurlin to underlying support structure.

SUMMARY OF THE INVENTION

In a first preferred embodiment of the present invention, a connector is provided for interconnecting a subpurlin with a roof structural assembly. The connector slidably engages the subpurlin to permit thermal expansion and contraction of the roof deck panels attached to the subpurlin. The connector is also provided with a boss which spaces the sliding bearing surface above the roof structural assembly to permit insulation to be placed between the roof structural assembly and the subpurlin. The surface area of the contact surface between the boss and the roof structural assembly is much less than the bearing surface on which the subpurlin slides to minimize the compression of the insulation at the point of attachment between the connector and the roof structural assembly.

In a preferred embodiment of the present invention, a subpurlin is provided for interconnecting a roof structural assembly and roof deck panels. The subpurlin is formed as an elongate member defining a plurality of slotted openings, each having a length which is effective to accommodate expansion and contraction movements of the roof deck panels relative to the underlying structural assembly. A connector is provided for slidably engaging the elongate member adjacent the roof structural assembly and beneath the roof deck panels. The connector includes a washer defining a bearing surface, and a ferrule which slidably engages a slotted opening in the elongate member, where the ferrule has a length which is effective to maintain the washer above the opening and in spaced relationship with the elongate member.

A method of assembly is also provided for forming an insulated roof structure over a plurality of underlying structural members. Insulating material is placed above and generally transverse to the structural members. A first subpurlin is placed above the insulating material and along one of the structural members, where the subpurlin has a plurality of low cell areas adjacent the structural member which define respective expansion slots therethrough, and a plurality of high cell areas extending above the insulating material. The subpurlin includes a plurality of spanner sections between and supported by the low cell areas. Bearing surfaces are formed above the expansion slots and spaced above the slots on ferrules extending through the slots. The bearing surfaces are fastened to the structural members through the ferrules, each of the ferrules maintaining its associated bearing surface spaced above the expansion slot.

An improved building assembly is provided having a plurality of overhead structural members, an insulating layer, and a plurality of overlapping external roof panels, where a plurality of subpurlins are provided for supporting and spacing the roof panels above the structural members. Connectors attach the subpurlins to the structural members in a manner which enables relative thermal movement between the roof panels and the structural members. Each subpurlin is an elongate member defining a plurality of slotted openings, each having a length which is effective to accommodate the expansion and contraction movement of the roof deck panels relative to the structural assembly. The connector slidably engages the elongate subpurlin adjacent the roof structural assembly and beneath the roof deck panels. Each connector includes a washer which defines a bearing surface and a ferrule which slidably engages a subpurlin slotted opening and which has a length effective to maintain the washer above the opening in a spaced apart relationship with the elongate member.

These and other characteristics of the present invention will become apparent from the following detailed description, wherein reference is made to the figures in the accompany drawings.

IN THE DRAWINGS

FIG. 6 is a perspective view of the underside of a connector forming one embodiment of the present invention illustrating the boss spacing the subpurlin sliding surface above the roof structural assembly.

FIG. 7 is a bottom plan view of the connector.

FIG. 8 is a side view of the connector mounted on the roof structural assembly illustrating the minimal compression of the insulation between the connector and the roof structural assembly.

FIG. 9 is an end view of the connector mounted to the roof structural assembly illustrating the minimum compression of the insulation therebetween.

DETAILED DESCRIPTION

Figures 1, 2, 3:
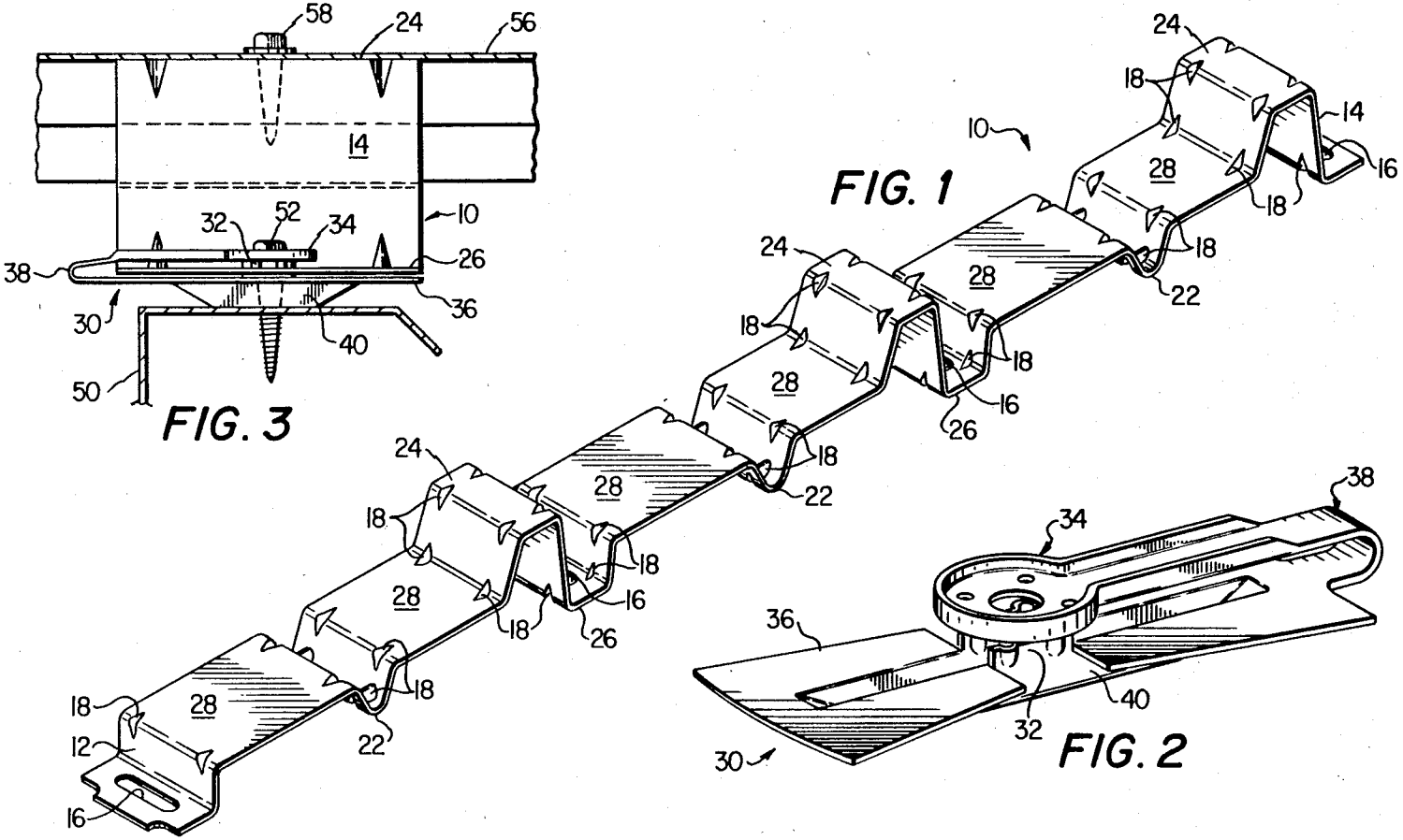
FIG. 1 is a pictorial illustration of one embodiment of a subpurlin in accordance with the present invention.
FIG. 2 is a pictorial illustration of one embodiment of a subpurlin fastening clip.
FIG. 3 is a side elevation in partial cutaway of an installed subpurlin with clip.

Referring now to the figures, and more particularly to FIG. 1, there is shown one embodiment of subpurlin 10 according to the present invention. Subpurlin 10 is formed as an elongate member having a lap end 12 and rib end 14. Lap end 12 mates with the rib end 14 of an adjacent subpurlin 10, as hereinafter explained. In a preferred embodiment, subpurlin 10 is about 36 inches long and three inches wide, a size consistent with conventional building materials.

Subpurlin 10 defines a plurality of expansion slots 16 along its length. An expansion slot is included at lap end 12 and rib end 14 and at intermediate locations where subpurlin 10 contacts the underlying support structure.

The configuration of the elongate subpurlin 10 includes intermediate bearing stiffeners 22, high cell ribs 24, low cell ribs 26 and connecting spanner sections 28. Spanner sections 28 are supported above underlying structural members by flanges at lap end 12 and rib end 14, by intermediate bearing stiffeners 22, and by low cell ribs 26. Bearing stiffeners 22 serve to provide the desired rigidity to spanner sections 28 at desired locations. Reinforcing embossments 18 provide additional strength at locations where subpurlin 10 is bent.

Preferably low cell ribs 26 further define slots 16. Slots 16 have a length which is effective to enable relative thermal expansion movements to occur between the overlying roof structure and the underling structural members, as hereinafter explained. High cell ribs 24 may be provided in a variety of configurations. It is desirable, however, that the selected configuration be compatible with elongate ribs of the overlying roof deck panels to provide for attaching the deck panels to the high cell ribs 24.

Referring now to FIG. 2, there is shown connecting slider assembly 30 for joining subpurlin 10 with the underlying structural members. Slider tab 32 is formed as a ferrule for engaging expansion slots 16 in subpurlin 10 (see FIG. 1). Washer 34 is placed above ferrule 32 and defines a bearing surface for use in fastening the assembly together, as hereinafter explained. As shown in FIG. 2, washer 34 is supported above ferrule 32 by connecting biasing arms 38 to form a unitary connector assembly 30 which is convenient for field installation.

Thus, referring to FIGS. 1 and 2, connecting slider assembly 30 is installed by urging washer 34 above a low cell rib area 26 of subpurlin 10 and along low cell rib 26 until ferrule 32 is engaged through expansion slot 16. Bottom sliding surface 36 may then be dimensionally formed to have the same length as the width of subpurlin 10 so that alignment is easily accomplished, either visually or by feel. Structural bearing surface 40 is placed adjacent an underlying structural assembly member, a fastener is inserted through washer 34 and ferrule 32, and the fastener is rotated to secure washer 34 against ferrule 32. While a threaded fastener 52 is shown, any suitable fastener can be used to suit the structural assembly member. A nail could be used when the structural assembly member is wood, for example. The dimensions of ferrule 32 are selected such that expansion slot 16 slidably engages ferrule 32 when washer 34 is clamped against ferrule 32. Thus, low cell rib areas 26 slidably engage bottom sliding surface 36 as the assembly is fastened to the underlying support structure.

Referring now to FIG. 3, there is depicted a side elevation, in partial cutaway, of a subpurlin 10 fastened through connector 30 to an underlying structural member 50. Structural member 50 may be a purlin or may be a primary structural member such as a bar joist. Biasing arms 38 have been spread to move connecting slider assembly 30 about rib end 14 (as shown in FIG. 1) until ferrule 32 has engaged through expansion slot 16 (not shown). Structural bearing surface 40 of slider assembly 30 is placed adjacent structural member 50 and fastener 52 is installed to secure washer 34 adjacent ferrule 32 and connector assembly 30 to structural member 50. Thus, the flange portion of rib end 14 is fastened, but not clamped, to structural member 50 wherein expansion slot 16 (not shown) can slide about ferrule 32 and beneath washer 34 over sliding surface 36 to accommodate relative movement between the overlying roof panel and structural member 50. Finally, a rib of roof panel 56 has been placed over high cell rib 24 adjacent rib end 14 and fastened to high cell rib 24 by fastener 58.

Figure 4:
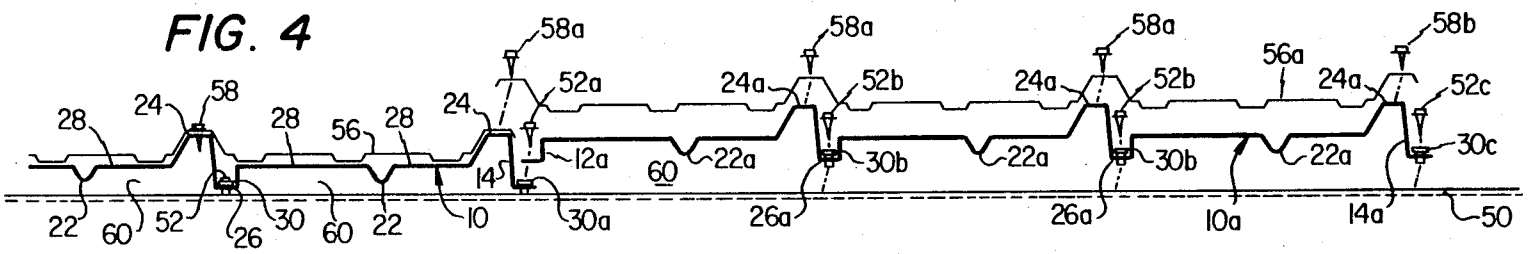
FIG. 4 is an exploded side view of an installation showing a sequence of assembly.

A typical installation sequence for installing subpurlins 10 and overlying roof panels 56 is shown in FIG. 4. At the left side of FIG. 4, a first subpurlin 10 is fastened to structural member 50 at intermediate low cell rib 26 with fastener 52 secured through connecting slider assembly 30. Intermediate bearing stiffeners 22 support spanner sections 28 above support member 50, forming insulation space 60 to accommodate insulating material without compressing the insulating material. Roof panel 56 is secured to high cell ribs 24 of subpurlin 10 with fastener 58. Installation of subpurlin 10 is completed except rib end 14 is not secured to support member 50 and the adjoining roof panel is not secured to high cell rib 24 adjacent rib end 14.

Adjoining subpurlin **10*a* is next installed. Lap end 12*a* is placed adjacent rib end 14. Connector slider assembly 30*a* may be slipped over both flange areas where the ferrule 32 (FIG. 2) passes through the mating expansion slots (not shown) of lap end 12*a* and rib end 14. Fastener 52*a* now fixes slider assembly 30*a* to support member 50. Subpurlin 10*a* is then fixed along support member 50 by successively fastening slider assemblies 30*b* with fasteners 52*b* until rib end 14*a* is reached. If subpurlin 10*a* is the last subpurlin in a given sheet run (i.e., the distance from eave to endlap, eave to ridge, etc.), then installation is completed by installing slider assembly 30*c* with fastener 52*c*. Otherwise the next subpurlin is placed adjacent rib end 14*a***, as hereinabove described.

Roof sheets 56 and **56*a* are fastened to subpurlins 10 and 10*a* with fasteners 58, 58*a*, 58*b* at high cell ribs 24, 24*a*. It will be appreciated that fasteners 58, 58*a*, 58*b* are fixed to raised locations of roof sheet panels 56, 56*a* such that water properly drains away from fasteners 58, 58*a*, 58*b*** and does not accumulate in a manner to cause leakage or corrosion of roof panel material adjacent the fasteners.

Figure 5:
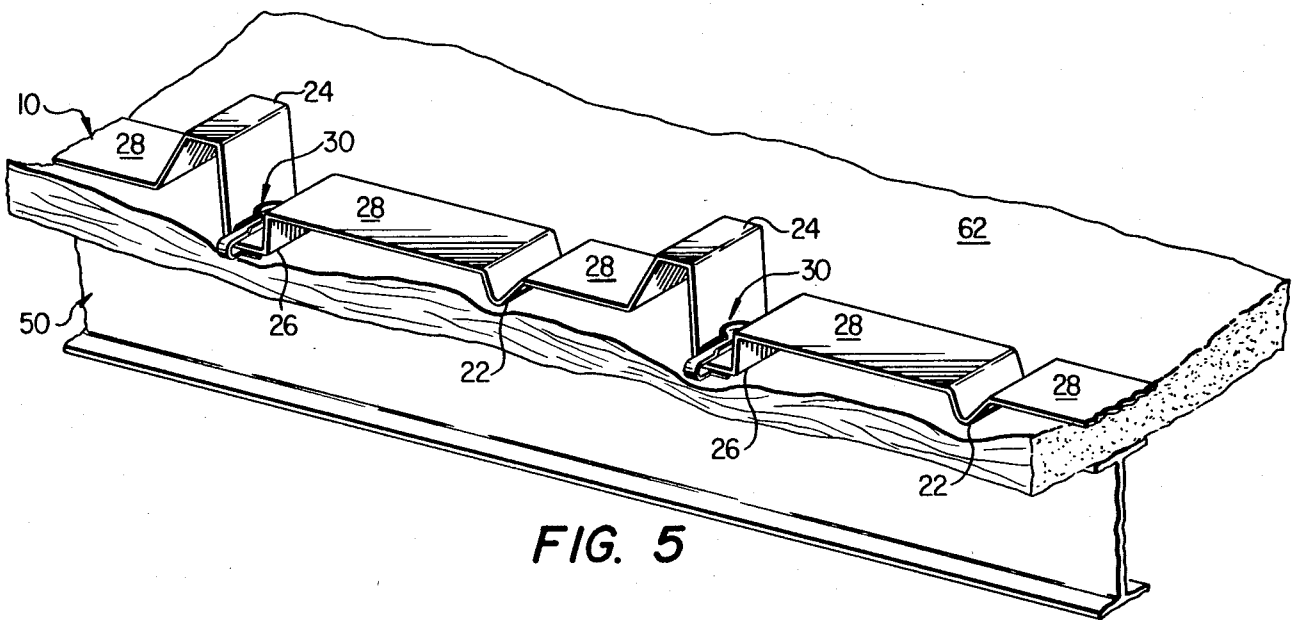
FIG. 5 is a pictorial illustration of a building component assembly incorporating embodiments of the present invention.

A pictorial illustration of a subpurlin assembly according to the present invention and installed on a structural support member having a layer of insulating material is shown in FIG. 5. Subpurlin 10 has been placed along support member 50 and fixed to support member 50 by fasteners fixed through connector slider assemblies 30. Low cell ribs 26 and bearing stiffeners 22 support spanner sections 28 above insulation 62 without any substantial compression of insulation 62. High cell ribs 24 extend above insulation 62 to support overlying roof panels (not shown) above insulation 62. Thus, the overlying roof panels (not shown) will be fastened to subpurlins 10. Subpurlins 10 will be slidingly fixed to support member 50 through connecting slider assemblies 30. Relative thermal movements transverse to support member 50 occur without producing strains on overlapping longitudinal ribs of the overlying roof panels 56 (not shown).

With reference now FIGS. 5–9, further details of the connector 30 will be described. In function, the connector spaces the bottom sliding surface 36 on which the subpurlin 10 rests above the structural assembly member 50. This spacing is achieved by the boss 102 which forms part of the connector 30 and extends downwardly from the material forming the bottom sliding surface 36. As can be seen, the boss 102 tapers downwardly and inwardly at ends 104 to reduce the surface area of the structural bearing surface 40 actually resting on the structural assembly member 50. This minimizes the compression of the insulating material 100 yet provides a stable and secure attachment for the subpurlin on the structural assembly member.

In one embodiment of the present invention, the bottom sliding surface 36 is $3\frac{1}{4}''$ long to accommodate the 3" width of the subpurlin 10. The surface 36 is $1\frac{1}{4}''$ wide to provide an adequate support surface for the subpurlin. The structural bearing surface 40 of the boss 102 is reduced to a contact surface with the structural assembly member 50 of only 5/16" wide by $1\frac{1}{2}''$ long. Thus, by using the boss 102, the area of compression of the insulating material where the connector is attached to the structural assembly member is greatly reduced as best seen in FIGS. 8 and 9. In this embodiment, the height of the boss was approximately $\frac{1}{4}''$, which is approximately the distance from the top of the structural assembly member 50 to the bottom sliding surface 36. With insulation of, for example, 5" uncompressed thickness, the use of the connector minimizes the necessary compression in order to provide a rigid connection between the subpurlins and the structural assembly members 50.

In the preferred embodiment, the connector 30 is stamped from a single sheet of material into the shape as shown in the drawings and described herein.

It is therefore apparent that the present invention is one well adapted to obtain all of the characteristics hereinabove set forth together with other characteristics which will become obvious and inherent from a description of the product itself. It will be understood that certain combinations and subcombinations are of utility and may be obtained without reference to other features and subcombinations. This is contemplated by and is within the scope of the present invention.

What is claimed is:

1. A unitary slider assembly for interconnecting a subpurlin having an elongate slot therein and a roof structural assembly, comprising:

a member defining a sliding surface for contacting the subpurlin on one side of the subpurlin around the elongated slot, said member further having a ferrule extending from the sliding surface through the elongated slot and an ending beyond the opposite surface of the subpurlin to define a bearing surface; and said member further having a portion extending therefrom and curved about an edge of the subpurlin to define a washer proximate the bearing surface, said portion being resilient to permit the portion to be deflected so that the washer moves away from the bearing surface to slide the slider assembly over the edge of the subpurlin with the ferrule extending through the elongate slot, said washer and ferrule having an aperture formed therethrough for receiving a fastener to fasten the subpurlin to the roof structural assembly so that the subpurlin can slide relative to the slider and roof structural assembly along the direction of the elongated slot.

2. The unitary slider assembly of claim 1, wherein said member further defines a boss, the boss defining a structural bearing surface spaced from the sliding surface, said structural bearing surface for bearing on the roof structural assembly, the boss spacing the sliding surface from the structural bearing surface to minimize compression of insulation positioned between the unitary slider assembly and the roof structural assembly.

3. The unitary slider assembly of claim 2, wherein the surface area of the structural bearing surface on the boss is substantially less than the surface area of the sliding surface to minimize compression of insulation between the unitary slider assembly and the structural assembly member.

4. The unitary slider assembly of claim 1, wherein the unitary slider assembly is a single piece unit stamped from a sheet.

5. The unitary slider assembly of claim 3, wherein the dimensions of the sliding surface are approximately $3\frac{1}{4}''$ by $1\frac{1}{4}''$ while the dimensions of the structural bearing surface are approximately 5/16" by $1\frac{1}{2}''$, the boss spacing the sliding surface approximately $\frac{1}{4}''$ away from the structural assembly member.

* * * * *

UNITED STATES PATENT AND TRADEMARK OFFICE

CERTIFICATE OF CORRECTION

PATENT NO. : 4,747,249

DATED : May 31, 1988

INVENTOR(S) : Bell, III et al.

It is certified that error appears in the above-identified patent and that said Letters Patent is hereby corrected as shown below:

Column 6, line 43, after "slider" insert --assembly--.

Column 6, lines 58-59, change "structural assembly member" to --roof structure assembly--.

Column 6, line 67, insert "roof" before --structural assembly--.

Column 6, line 67, delete "member".

Signed and Sealed this

Twelfth Day of October, 1993

*Attest:*

*Attesting Officer*

BRUCE LEHMAN

*Commissioner of Patents and Trademarks*